US012202589B2

(12) United States Patent
Aoun et al.

(10) Patent No.: US 12,202,589 B2
(45) Date of Patent: Jan. 21, 2025

(54) POWER SUPPLY AND COOLING SYSTEM FOR A FLOATING STRUCTURE

(71) Applicant: GAZTRANSPORT ET TECHNIGAZ, Saint Remy les Chevreuse (FR)

(72) Inventors: Bernard Aoun, Saint Remy les Chevreuse (FR); Pavel Borisevich, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 50 days.

(21) Appl. No.: 18/257,345

(22) PCT Filed: Dec. 13, 2021

(86) PCT No.: PCT/FR2021/052291
§ 371 (c)(1),
(2) Date: Jun. 14, 2023

(87) PCT Pub. No.: WO2022/129755
PCT Pub. Date: Jun. 23, 2022

(65) Prior Publication Data

US 2024/0101241 A1 Mar. 28, 2024

(30) Foreign Application Priority Data

Dec. 18, 2020 (FR) ..... 20 13752

(51) Int. Cl.
*B63J 2/14* (2006.01)
*F25J 1/00* (2006.01)
*F25J 1/02* (2006.01)

(52) U.S. Cl.
CPC ..... *B63J 2/14* (2013.01); *F25J 1/0025* (2013.01); *F25J 1/0037* (2013.01); *F25J 1/0045* (2013.01); *F25J 1/0245* (2013.01); *F25J 1/0277* (2013.01)

(58) Field of Classification Search
CPC .. B63J 2/14; F25J 1/0025; F25J 1/0037; F25J 1/0045; F25J 1/0245; F25J 1/0277; F25J 1/0288; F25J 1/0292
See application file for complete search history.

(56) References Cited

U.S. PATENT DOCUMENTS 3,494,145 A * 2/1970 Hunt ..... F25B 9/06 62/88
2018/0245843 A1 8/2018 Ragot
(Continued)

FOREIGN PATENT DOCUMENTS

EP 3 375 704 A1 9/2018
EP 3 508 773 A1 7/2019
(Continued)

OTHER PUBLICATIONS

International Search Report issued Mar. 29, 2022 in PCT/FR2021/052291, filed on Dec. 13, 2021, 2 pages.

*Primary Examiner* — P. Macade Nichols
(74) *Attorney, Agent, or Firm* — Oblon, McClelland, Maier & Neustadt, L.L.P.

(57) ABSTRACT

A power supply and cooling system for a floating structure having a tank, includes a supply circuit having at least one compression device, the supply circuit being configured to supply gas to a gas-consuming device, and a cooling circuit having a heat exchanger configured to participate in managing the internal pressure of the tank, the cooling circuit being connected to the supply circuit on either side of the compression device. The compression device includes two compression stages, and the power supply and cooling system includes a control device configured to connect the compression stages in series or in parallel.

15 Claims, 9 Drawing Sheets

(56) References Cited

U.S. PATENT DOCUMENTS

Figure 1:
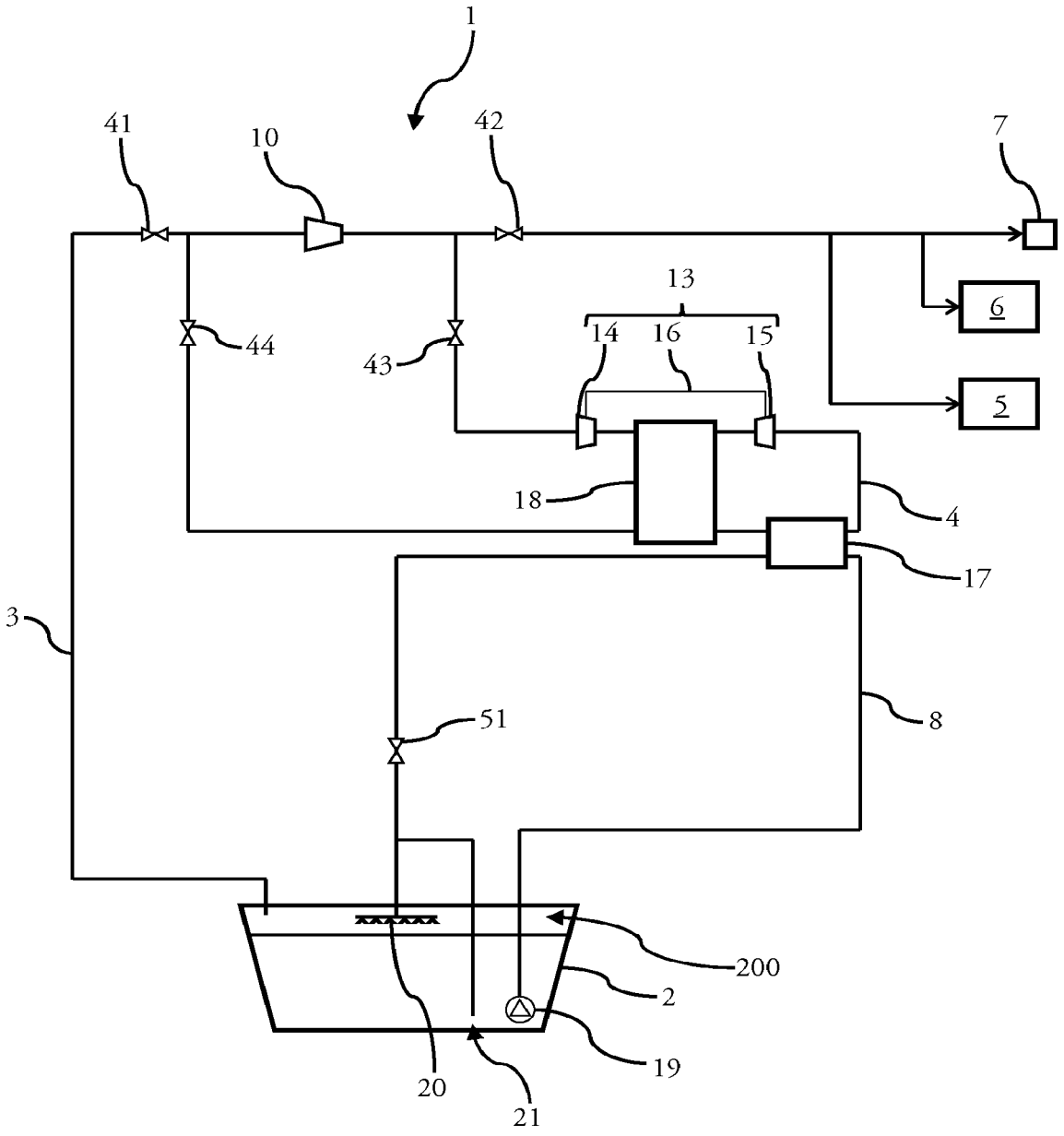

| | | | |
|---|---|---|---|
| 2018/0327056 | A1 | 11/2018 | Lee et al. |
| 2020/0393196 | A1 | 12/2020 | Cho et al. |
| 2021/0071815 | A1 | 3/2021 | Ragot |

FOREIGN PATENT DOCUMENTS

| | | | |
|---|---|---|---|
| EP | 3 733 499 | A1 | 11/2020 |
| FR | 3 066 257 | A1 | 11/2018 |
| WO | WO 2017/037400 | A1 | 3/2017 |
| WO | WO 2020/109580 | A1 | 6/2020 |

* cited by examiner

POWER SUPPLY AND COOLING SYSTEM FOR A FLOATING STRUCTURE

The present invention relates to the field of floating structures for storing and/or transporting gas in the liquid state and relates more particularly to a gas supply and cooling system installed within such floating structures.

During a journey made by a ship comprising a tank of gas in the liquid state intended to be delivered to a destination point, said ship may be able to use at least some of said gas in the liquid state in order to supply at least one of its engines, via a gas supply system. At the same time, it is necessary to keep the pressure inside the tank at an acceptable level, in particular by keeping the gas cargo in the liquid state at an adequate temperature.

In this respect, it is known to use a supply circuit making it possible to suck in the gas that has evaporated, then to compress it in order to supply the engine or engines. In a parallel or alternative manner, the pressure within the tank can be lowered thanks to a cooling circuit making it possible to circulate a refrigerant in order to reliquefy a fraction of the gas having evaporated within the tank.

These two circuits are regularly found within floating structures and generate a size and a cost which are not insignificant. One objective is therefore to improve the supply and cooling system in order to reduce said size and cost. Reducing the size also makes it possible to limit the quantity of lines within the circuits. The maintenance of these circuits is therefore simplified and a malfunction that may occur in one or the other of the circuits is detected more quickly.

One of the existing solutions is to install a compression device making it possible both to compress the gas intended to supply the engine and to compress the refrigerant in order to limit the number of compression devices, but the gas supplying the engine and the refrigerant do not meet the same compression conditions to ensure their respective functions.

The invention makes it possible to solve this problem by proposing a gas supply and cooling system for a floating structure comprising at least one tank configured to contain the gas, the supply and cooling system comprising:

at least one supply circuit intended to be traversed by gas coming from the tank, and comprising at least one compression device, the supply circuit being configured to connect the compression device to a headspace of the tank, and to supply gas to at least one gas-consuming device which equips the floating structure, at least one cooling circuit intended to be traversed by a refrigerant, comprising at least one heat exchanger configured to participate in an internal pressure management of the tank, an internal heat exchanger and a turbocompressor comprising a compression member arranged upstream of a first pass of the internal heat exchanger and a turbine arranged downstream of the first pass of the internal heat exchanger, the compression member and the turbine being connected in rotation by a shaft, the cooling circuit being connected to the supply circuit on either side of the compression device, characterized in that the compression device comprises at least two compression stages, the supply and cooling system comprising a control device configured to connect the compression stages in series when the compression device supplies the gas-consuming device and to connect the compression stages in parallel when the compression device supplies the cooling circuit.

The role of the cooling circuit is to cool the gas contained in the tank by managing the internal pressure of the tank.

Such a supply and cooling system thus makes it possible to ensure the function of supplying the gas-consuming device and the function of managing the internal pressure in the tank, with the aid of a single compression device. The fact that the compression stages of the compression device can be arranged in series or in parallel makes it possible to optimally compress any fluid circulating through the compression device, regardless of its nature and/or its destination.

When the fluid compressed by the compression device is gas coming from the tank and intended to supply the gas-consuming device, the compression stages of the compression device are arranged in series in order to favor the pressure of the gas over the flow passing through the compression device.

When the fluid compressed by the compression device is refrigerant allowing the pressure management of the tank, the compression stages of the compression device are arranged in parallel in order to favor the flow of refrigerant passing through the compression device over the pressurization of said refrigerant.

During the transport of a cargo of gas in liquid form, the latter can partially vaporize within the tank, naturally or in an induced manner, in order to supply the gas-consuming device. In order to lower the internal pressure of the tank, the gas in the vapor state can either be evacuated via the supply circuit or be recondensed and sent into the tank, directly or indirectly via the cooling circuit.

The compression device compresses the gas circulating in the supply circuit from the tank. The compressed gas can then flow to the gas-consuming device to supply the latter, or else flow to the cooling circuit in order to act as a refrigerant. The refrigerant can also be a third-party fluid only used as a refrigerant. Such a third-party fluid can also be compressed by the compression device.

The compression member and the turbine, by their mechanical connection, are driven in rotation with each other. The turbine is driven in rotation and thus drives the shaft in rotation, which itself drives the compression member in rotation. The refrigerant is therefore initially compressed by the compression member. The refrigerant then passes through the internal heat exchanger via the first pass and is then expanded while passing through the turbine. The refrigerant then passes through the heat exchanger, which then makes it possible to manage the internal pressure of the tank. It is thus understood that the refrigerant circulating in the cooling circuit participates in the cooling of the gas in the liquid state contained in the tank via the heat exchanger.

The control device allows the connection of the compression stages in series or in parallel depending on the nature of the fluid circulating through the compression device or depending on the need to which the supply and cooling system must respond.

According to one feature of the invention, the control module comprises a main line passing through each of the compression stages of the compression device. When the compression stages are connected in series, the fluid compressed by the compression device circulates within the main line in order to pass through each of the compression stages.

According to one feature of the invention, the control module comprises at least one peripheral line connected to the main line and at least one valve which controls the flow circulating on said peripheral line, the peripheral line bypassing a compression stage. Each compression stage is bypassed by a peripheral line in order to allow in particular the connection of the compression stages in parallel with respect to one another. The fluid thus circulates only partially within the main line and separates into as many fractions as there are compression stages, each of the fractions bypassing a compression stage while circulating within a peripheral line. The connection in series or in parallel is made by opening or closing the valves, authorizing access or not to the main line and/or to the peripheral lines making it possible to bypass the compression stages.

According to one feature of the invention, the internal heat exchanger comprises a first pass and a second pass thermally exchanging with each other, the first pass being arranged upstream of the heat exchanger and the second pass being arranged downstream of the heat exchanger. The internal heat exchanger thus makes it possible to pre-cool the refrigerant before it passes through the turbine. On leaving the heat exchanger, the refrigerant passes through the second pass of the internal heat exchanger to regulate the temperature within the cooling circuit.

According to one feature of the invention, the compression device of the supply circuit is a first compression device, the supply and cooling system comprising a second compression device installed in parallel with the first compression device. Installing two compression devices in parallel allows, for example, the functions of the supply and cooling system to be ensured in the event that one of the compression devices fails. Installing two compression devices also makes it possible to guarantee the supply of the gas-consuming device and the management of the internal pressure in the tank simultaneously, each of the compression devices being specific to each of the needs. Both compression devices can also be assigned to the same need.

According to one feature of the invention, the second compression device comprises at least two compression stages, the control device being configured to connect the compression stages of the second compression device in series when the second compression device supplies the gas-consuming device and to connect the compression stages of the second compression device in parallel when the second compression device supplies the cooling circuit. In other words, the structure of the second compression device is identical to that of the first compression device. The second compression device is therefore also capable of supplying the gas-consuming device or the cooling circuit.

According to one feature of the invention, the supply and cooling system comprises a circuit for gas in the liquid state intended to be traversed by gas in the liquid state coming from the tank, and configured to take the gas in the liquid state contained in the tank, the heat exchanger effecting a heat exchange between the gas in the liquid state of the circuit for gas in the liquid state and a refrigerant circulating in the cooling circuit. Such an operation is intended to manage the saturation pressure of the tank by limiting the presence of gas in the vapor state at the headspace of the tank. The gas in the liquid state can for example be pumped to circulate within the circuit for gas in the liquid state. The gas in the liquid state is cooled by the refrigerant in order to subsequently act on the pressure within the tank. Once the gas in the liquid state has been cooled by means of the cooling circuit, said gas is then at a lower temperature than the gas in the liquid state contained in the tank. The return of the cooled gas thus causes a drop in the average temperature of the tank, which also ensures a drop in the saturation pressure of the tank.

According to one feature of the invention, the circuit for gas in the liquid state comprises a member for spraying the gas in the liquid state into the tank headspace and an outlet orifice arranged in a lower part of the tank. Once cooled by the refrigerant via the heat exchanger, the gas in the liquid state can be projected in the form of a spray at the headspace of the tank. The spraying of gas in the cold liquid state at the headspace of the tank via the spraying member makes it possible to at least partially condense the gas in the vapor state present in the headspace of the tank. The condensation of the gas in the vapor state thus makes it possible to lower the pressure within the tank. The gas in the cooled liquid state can also return to the lower part of the tank.

According to one feature of the invention, the supply and cooling system comprises a return line connected to the supply circuit downstream of the compression device and extending as far as the circuit for gas in the liquid state, the supply and cooling system comprising a first heat exchanger effecting a heat exchange between the gas circulating in the return line and the gas circulating in the circuit for gas in the liquid state. It may happen that the gas in the vapor state is sent to the gas-consuming device in too large a quantity, or that the gas in the vapor state is present in too large a quantity in the headspace of the tank for the cooling circuit to be able to completely condense the gas in the vapor state.

When the gas in the vapor state is sent to the gas-consuming device, the excess gas can for example be burned or released into the atmosphere. The return line makes it possible to offer an alternative to this loss, by circulating the excess gas as far as the circuit for gas in the liquid state in order to return it to the tank.

In order to condense the gas in the vapor state circulating in the return line, a heat exchange takes place between the gas circulating in the return line and the gas in the liquid state circulating in the circuit for gas in the liquid state and having been cooled by passing through the heat exchanger. The heat exchanger thus acts as a condenser for the gas circulating in the return line. Once this heat exchange has taken place, the condensed gas returns to the tank via the outlet orifice, or can be sprayed via the spraying member.

According to one feature of the invention, the supply and cooling system comprises a second heat exchanger effecting a heat exchange between the gas circulating in the supply circuit upstream of the compression device, and the gas circulating in the return line upstream of the first heat exchanger. The gas circulating in the supply line leaving the tank, it is at a lower temperature than the gas circulating in the return line. The second heat exchanger thus makes it possible to pre-cool the gas circulating in the return line before it is condensed by then passing through the first heat exchanger.

According to one feature of the invention, the heat exchanger is arranged at least partially at the headspace of the tank, that is to say so as to extend therein. This is an alternative embodiment, devoid of the circuit for gas in the liquid state. Thus, instead of cooling the gas in the liquid state circulating in the circuit for gas in the liquid state, the heat exchanger is placed directly at the headspace of the tank and acts as a condenser for the gas in the vapor state present in the headspace of the tank. The heat exchanger can for example be a gravity condenser. The refrigerant thus circulates within a spiral and thus condenses the gas in the ambient vapor state from the headspace of the tank. Once condensed, the gas in the liquid state joins the liquid part of the cargo.

The invention also covers a method for managing a gas contained in a tank, implemented by a supply and cooling system according to any one of the preceding features, comprising:

a first step of determining a need to supply the gas-consuming device or a need to manage the pressure inside the tank, a second step of connection in series or in parallel of the compression stages of the compression device by the control module according to the determined need.

Such a method thus makes it possible to adapt the type of connection of the compression stages of the compression device to the given need.

According to one feature of the method, according to a first operating mode, the first compression device, whose compression stages are connected in series, supplies the gas-consuming device while the second compression device, whose compression stages are connected in parallel, supplies the cooling circuit.

According to one feature of the method, according to a second operating mode, the first compression device and the second compression device, whose compression stages are connected in series, supply the gas-consuming device.

According to one feature of the method, according to a third operating mode, the first compression device and the second compression device, whose compression stages are connected in parallel, supply the cooling circuit.

Figure 2:
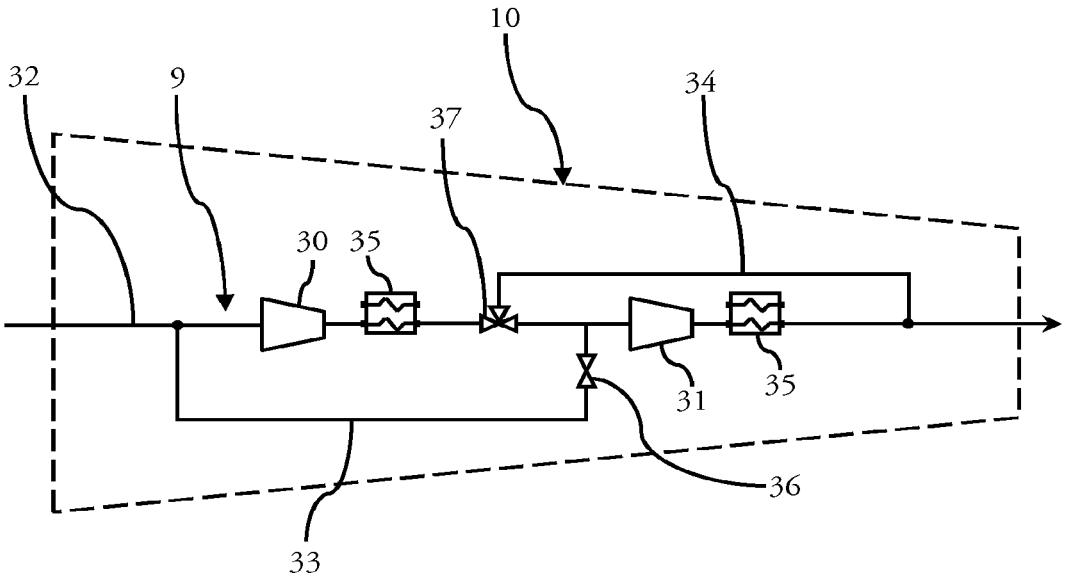
Figure 3:
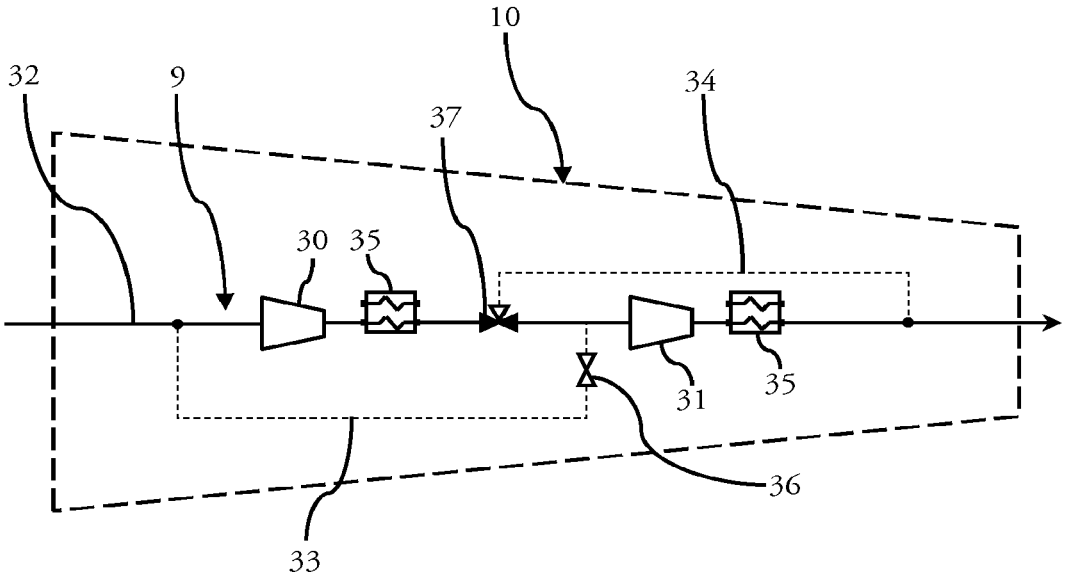
Figure 4:
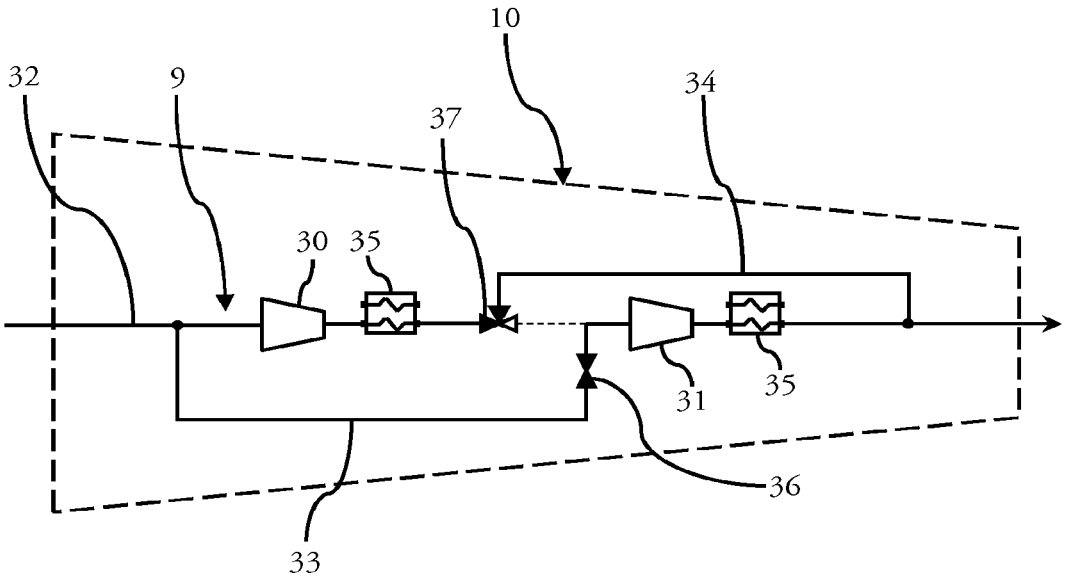
Figure 5:
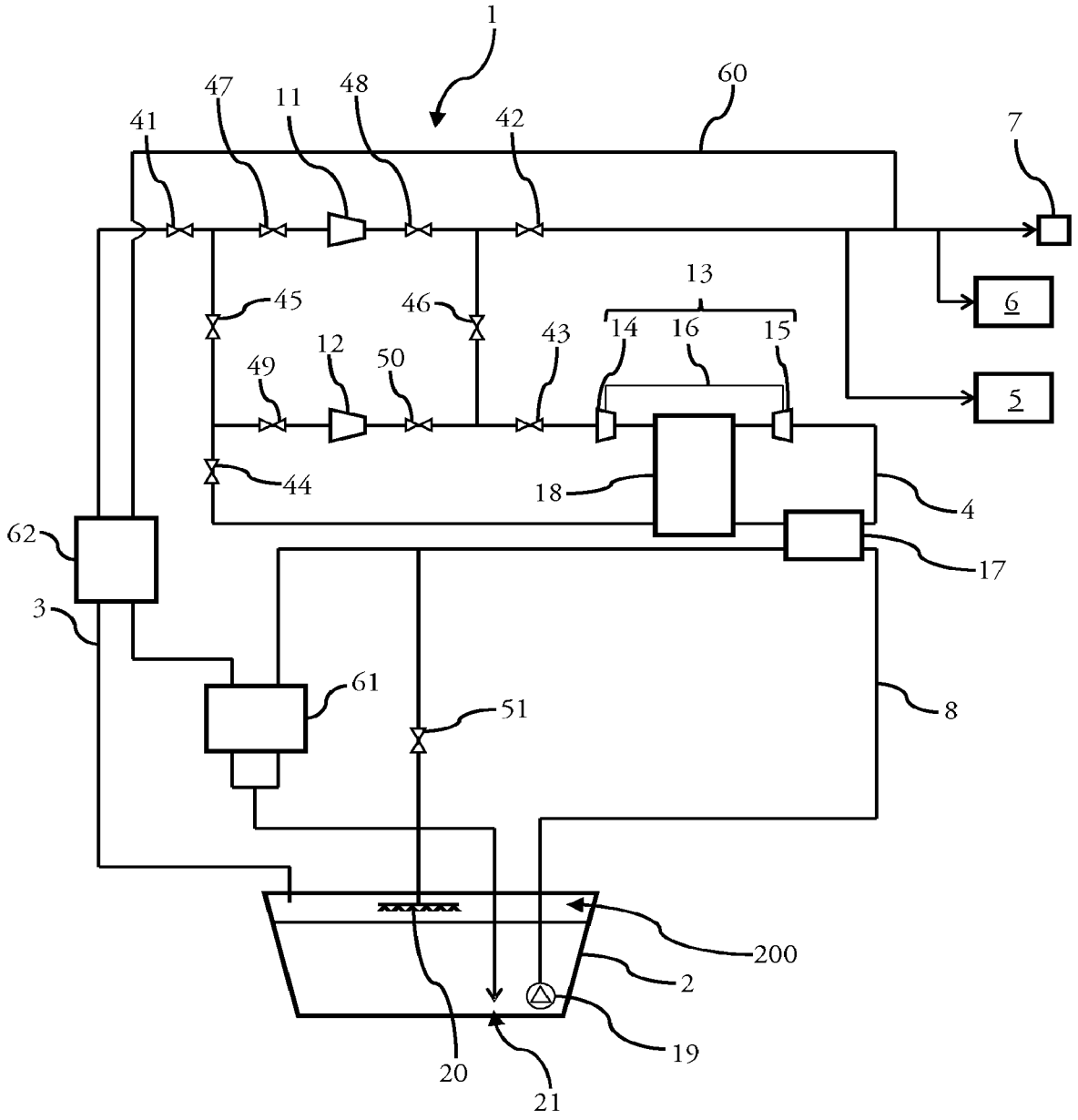
Figure 6:
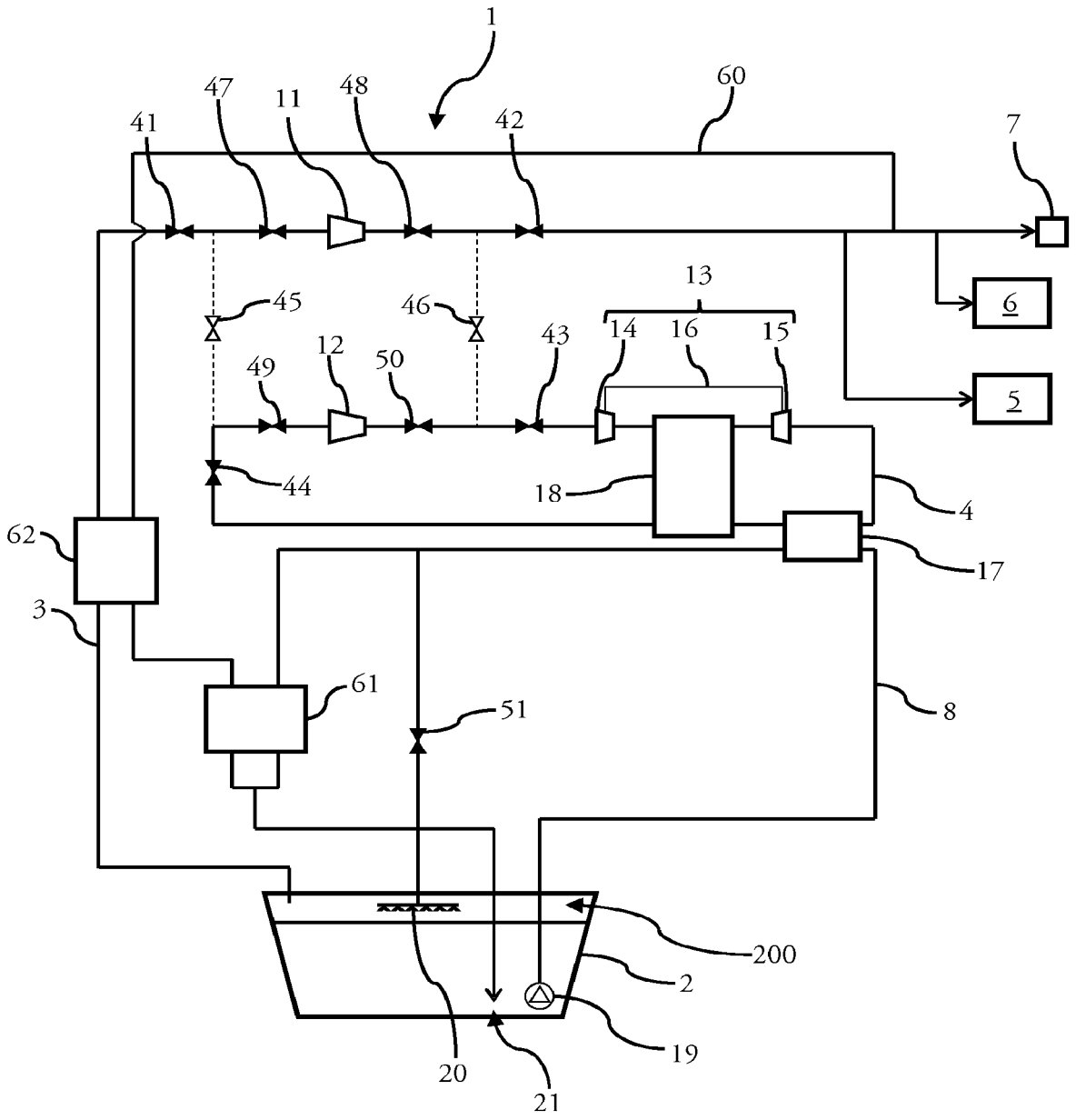
Figure 7:
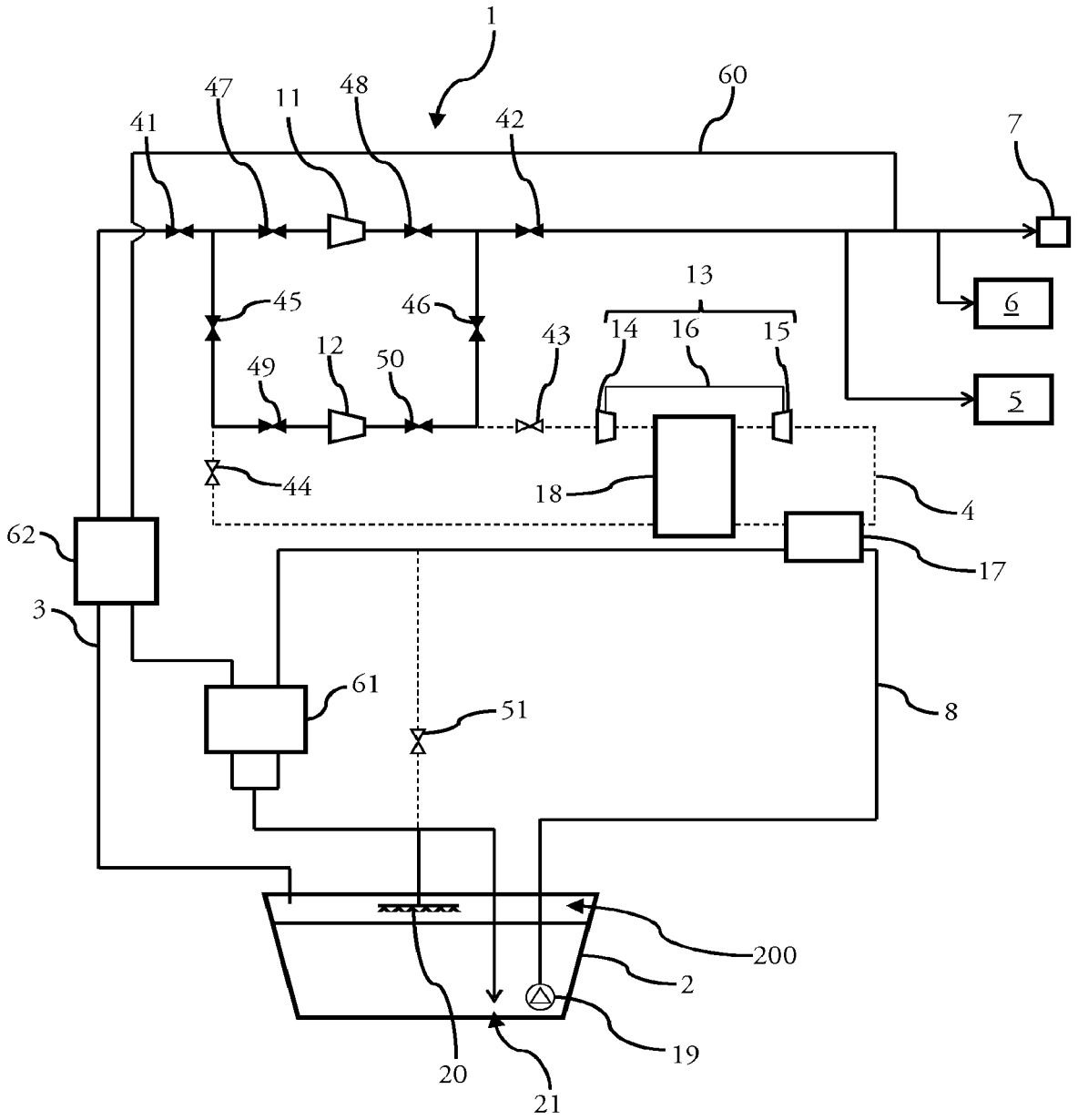
Figure 8:
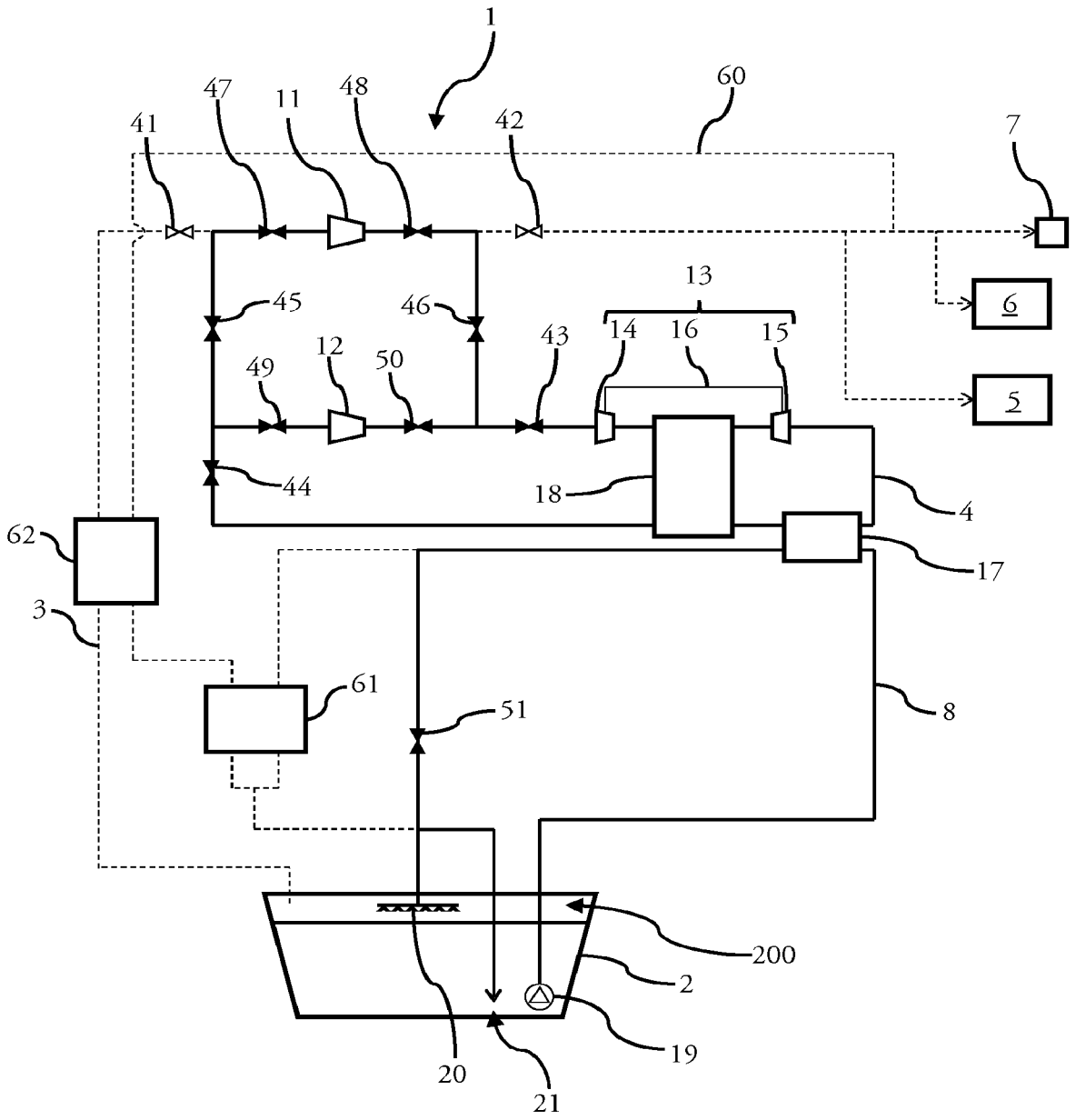
Figure 9:
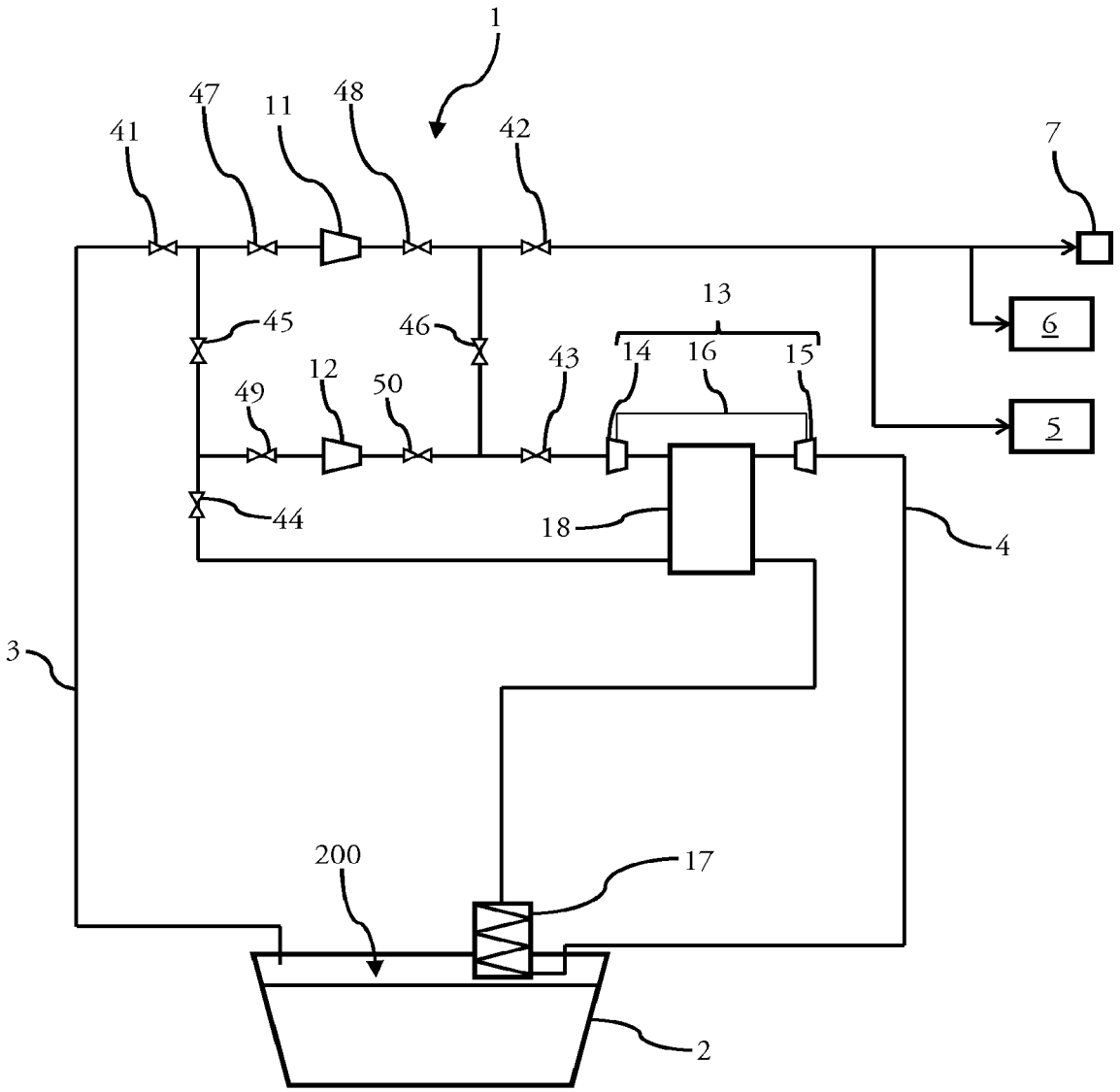

Other features and advantages of the invention will become apparent through the description which follows on the one hand, and several exemplary embodiments given by way of nonlimiting indication with reference to the appended diagrammatic drawings on the other hand, in which:

FIG. 1 is a general diagram of a first embodiment of a supply and cooling system according to the invention, FIG. 2 is a diagram representing the structure of a compression device present within the supply and cooling system, FIG. 3 shows a first arrangement of compression stages of the compression device, FIG. 4 shows a second arrangement of the compression stages of the compression device, FIG. 5 is a general diagram of a second embodiment of the supply and cooling system, FIG. 6 is a diagram representing a first operating mode of the second embodiment of the supply and cooling system, FIG. 7 is a diagram representing a second operating mode of the second embodiment of the supply and cooling system, FIG. 8 is a diagram representing a third operating mode of the second embodiment of the supply and cooling system, FIG. 9 is a general diagram of a third embodiment of the supply and cooling system.

FIG. 1 shows a supply and cooling device 1, which can be arranged within a floating structure capable of transporting and/or storing gas in liquid form, for example within a tank 2. This gas is for example natural gas. The gas in liquid form is stored in the tank 2 at very low temperature. For various reasons, for example naturally during transport, the gas in liquid form can partially evaporate at a headspace 200 of the tank 2. The gas evaporation phenomenon contributes to an increase in the internal pressure of the tank 2. Such an increase in the internal pressure must be regulated, for example by evacuating from the tank 2 the gas in the vapor state having formed in the headspace 200 of the tank. It is also possible to recondense the gas having evaporated so that the latter returns to liquid form, which leads to a reduction in the internal pressure of the tank 2.

The supply and cooling system 1 comprises a supply circuit 3. This supply circuit 3 is configured to suck in the evaporated gas that has formed in the headspace 200 of the tank 2. The gas can subsequently be used as fuel for a first gas-consuming device 5 and/or a second gas-consuming device 6. By way of example, the first gas-consuming device 5 can be an engine allowing the propulsion of the floating structure and the second gas-consuming device 6 can be an auxiliary motor responsible for the electrical supply of the floating structure.

In order to adapt the pressure of the gas circulating in the supply circuit 3 to raise it to a pressure compatible with the gas-consuming devices, the supply circuit 3 comprises a compression device 10 ensuring the compression of the gas. The latter can then supply the gas-consuming devices. If the latter do not require a supply of energy via the gas, this gas can be eliminated, for example via a burner 7.

The supply and cooling system also comprises a cooling circuit 4. The cooling circuit 4 is configured, directly or indirectly, to participate in the pressure management of the tank 2. The cooling circuit 4 is configured to circulate a refrigerant, which can for example be the gas sucked into the supply circuit 3, or else a third-party refrigerant.

The cooling circuit 4 is connected to the supply circuit 3, more particularly upstream and downstream of the compression device 10. The latter can thus participate in the circulation and compression of the refrigerant.

It is understood from the above that the compression device 10 can participate in the activity of the supply circuit 3 or in the activity of the cooling circuit 4. The determination of such an activity can for example depend on the position of a first valve 41 arranged on the supply circuit 3 upstream of the compression device 10 and the connection to the cooling circuit 4, of a second valve 42 arranged on the supply circuit 3 downstream of the compression device 10 and the connection to the cooling circuit 4, of a third valve 43 arranged on the cooling circuit 4 downstream of the compression device 10 and the connection to the supply circuit 3, and of a fourth valve 44 arranged on the cooling circuit 4 upstream of the compression device 10 and the connection to the supply circuit 3.

Thus, when the first valve 41 and the second valve 42 are in the open position, and the third valve 43 and the fourth valve 44 are in the closed position, the compression device 10 is integrated into the supply circuit 3 for the purpose of compressing the gas to supply gas-consuming devices.

When the first valve 41 and the second valve 42 are in the closed position, and the third valve 43 and the fourth valve 44 are in the open position, the compression device 10 is integrated into the cooling circuit 4 for the purpose of compressing the refrigerant to participate in the management of the pressure of the tank 2.

The cooling circuit 4 comprises a turbocompressor 13, an internal heat exchanger 18 and a heat exchanger 17. The turbocompressor 13 comprises a compression member 14 and a turbine 15 mechanically connected to each other by a shaft 16. The compression member 14 is arranged upstream of a first pass of the internal heat exchanger 18 while the turbine 15 is arranged downstream of this same first pass of the heat exchanger 18. The turbine 15 is set in rotation, and thus drives the shaft 16, which itself drives the compression member 14. The refrigerant is therefore initially compressed by the compression member 14 and then passes through the first pass of the internal heat exchanger 18 and is subsequently expanded by the turbine 15. The expansion allows a decrease in the temperature of the refrigerant which circulates through the heat exchanger 17, then through a second pass of the internal heat exchanger 18. There is therefore an exchange of heat between the refrigerant circulating within the first pass of the internal heat exchanger 18 and the refrigerant circulating within the second pass of the internal heat exchanger 18 in order to regulate the temperature of the refrigerant circulating in the cooling circuit 4.

The supply and cooling system 1 also comprises a circuit 8 for gas in the liquid state, within which circulates gas in liquid form coming from the tank 2. The circuit 8 for gas in the liquid state allows the condensation of the gas having evaporated in the headspace 200 of the tank 2 and thus participates in the management of the pressure of the tank.

The gas in the liquid state of the tank 2 is sucked into the circuit 8 for gas in the liquid state by means of a pump 19. The gas in the liquid state then circulates until it passes through the heat exchanger 17. It is thus understood that the heat exchange effected within the heat exchanger 17 is carried out between the refrigerant circulating in the cooling circuit 4 and the gas in the liquid state circulating in the circuit 8 for gas in the liquid state. The gas in the liquid state thus exits cooled from the heat exchanger 17.

After having been cooled, the gas in the liquid state can return to the lower part of the tank 2 via an outlet orifice 21. Such an operation contributes to lowering the average temperature of the tank 2, which leads to a drop in the saturation pressure of the tank 2 and thus a drop in pressure in the tank 2.

The gas in the cooled liquid state can also be sprayed in the form of a spray in the headspace 200 of the tank 2. To do this, the circuit for gas in the liquid state comprises a spraying member 20 for spraying of the gas in the liquid state. The spraying of the gas in the liquid state makes it possible to condense the gas having evaporated in the headspace 200 of the tank 2. The condensation of the gas thus reduces the quantity of evaporated gas, which therefore leads to a drop in the internal pressure of the tank 2. In order to authorize or not the circulation of the gas in the liquid state, the circuit 8 for gas in the liquid state comprises an additional valve 51.

FIG. 2 schematically illustrates a structure internal to the compression device 10. The compression of fluid within the compression device can be done in various ways, depending on the need to be met by the supply and cooling system. The fluid is compressed within the compression device 10 by a plurality of compression stages. In FIG. 2, the compression device 10 comprises a first compression stage 30 and a second compression stage 31. Each compression stage is followed by a cooler 35. The compression device 10 can comprise more than two compression stages.

The compression stages can be connected together in series or in parallel. Such a connection is made via a control module 9. The control module 9 comprises a main line 32 which extends from one end to the other of the compression device 10. The first compression stage 30 and the second compression stage 31 are both arranged on the main line 32.

The control module 9 also comprises a first peripheral line 33, connected to the main line 32 via a first connection arranged upstream of the first compression stage 30 and via a second connection arranged downstream of the cooler 35 of the first compression stage 30. The first peripheral line 33 is therefore configured to cause gas to circulate therein which bypasses the first compression stage 30. The first peripheral line comprises a first valve 36.

The control module 9 also comprises a second peripheral line 34, connected to the main line 32 via a first connection arranged downstream of the cooler 35 of the first compression stage 30 and via a second connection arranged downstream of the cooler 35 of the second compression stage 31. The second peripheral line 34 is therefore configured to cause gas to circulate therein which bypasses the first compression stage 30.

The second connection of the first peripheral line 33 is arranged downstream of the first connection of the second peripheral line 34. Thus, the gas circulating in the first peripheral line 33 cannot circulate within the second peripheral line 34 thereafter. The first connection of the second peripheral line 34 comprises a second valve 37 which can for example be a three-way valve.

FIG. 3 shows a first arrangement of compression stages of the compression device 10. In FIG. 3, as well as in FIG. 4, the solid lines representing the lines of the control module 9 correspond to lines where a fluid circulates therein, while the dotted lines correspond to lines where the fluid does not circulate. Within this first arrangement, the compression stages are connected in series with respect to one another. The series connection of the compression stages is implemented by the control module 9 when the gas circulating through the compression device 10 is intended to supply the gas-consuming devices shown in FIG. 1. When the gas is intended to supply said gas-consuming devices, the gas pressure must be favored over the flow rate. The gas must therefore be compressed by all of the compression stages, and a connection of said compression stages in series is more suitable.

When the compression stages are connected in series, the first valve 36 is closed. The gas therefore circulates only within the main line 32 and is compressed by the first compression stage 30, then passes through the cooler 35 of the first compression stage 30. The gas then reaches the second valve 37 which maintains the circulation of the gas within the main line 32 so that the gas is compressed by the second compression stage 31, then passes through the cooler 35 of the second compression stage 31 before leaving the compression device 10.

FIG. 4 shows a second arrangement of compression stages of the compression device 10. In FIG. 4, the compression stages are arranged in parallel with respect to one another. The arrangement in parallel is indicated when the compression device 10 compresses the refrigerant intended to circulate within the cooling circuit, in order to favor the flow rate of refrigerant over its pressure. For this second arrangement of compression stages, the control module 9 opens the first valve 36 arranged on the first peripheral line 33.

According to this arrangement, the refrigerant circulates within the main line 32 and separates into two fractions. A first fraction continues its circulation in the main line 32 and is compressed by the first compression stage 30 and then passes through the cooler 35 of the first compression stage 30. A second fraction circulates within the first peripheral line 33 and bypasses the first compression stage 30. The second fraction then reaches the main line 32 and is compressed by the second compression stage 31 and is cooled by the cooler 35 of the second compression stage 31.

The first refrigerant fraction reaches the second valve 37, which directs the refrigerant toward the second peripheral line 34 and thus bypasses the second compression stage 31.

Thus, the two refrigerant fractions have each been compressed by a compression stage. Connecting the compression stages in parallel ensures a higher fluid flow rate than a series connection.

FIG. 5 shows a second embodiment of the supply and cooling system 1. This second embodiment differs from the first embodiment in that it comprises a first compression device 11 and a second compression device 12. The first compression device 11 is installed in the supply circuit 3 while the second compression device 12 is installed within the cooling circuit 4. The function of the two compression devices is, however, not defined by their location, as will be described in detail later.

The presence of two compression devices also makes it possible to set up redundancy within the supply and cooling system 1. Thus, for example, if one of the compression devices breaks down, the other compression device can still perform its function and keep the supply and cooling system 1 operational.

The supply circuit 3 and the cooling circuit 4 both comprise a plurality of valves allowing access to each of the circuits to each of the compression devices so that the latter can both meet the gas supply needs of the gas-consuming devices or, if necessary, the refrigerant supply needs of the cooling circuit. Thus, in addition to the four valves already found in the first embodiment, the second embodiment of the supply and cooling system 1 comprises a fifth valve 45, a sixth valve 46, a seventh valve 47, an eighth valve 48, a ninth valve 49 and a tenth valve 50.

The fifth valve 45 and the sixth valve 46 allow the connection of the first compression device 11 to the cooling circuit 4 or else the connection of the second compression device 12 to the supply circuit 3 depending on the configuration of the supply and cooling system 1.

The seventh valve 47 and the eighth valve 48 are installed on either side of the first compression device 11 and make it possible to isolate the latter when they are in the closed position. Closing these valves is useful in the event of failure of the first compression device 11. The ninth valve 49 and the tenth valve 50 make it possible for their part to isolate the second compression device 12 from the rest of the supply and cooling system 1.

The supply and cooling system 1 also comprises a return line 60 connected to the supply circuit 3, upstream of the second gas-consuming device 6 and the burner 7. The return line 60 makes it possible to recirculate the excess gas circulating within the supply line 3 and not necessary for the consumption of the gas-consuming devices. Thus, instead of being eliminated by the burner 7, the gas circulates in the return line in order to return to the tank 2.

In order to recondense the gas circulating in the return line 60, the supply and cooling system 1 comprises a first heat exchanger 61 and a second heat exchanger 62. The first heat exchanger 61 operates a heat exchange between the gas circulating in the return line 60 and the gas in the cooled liquid state circulating in the circuit 8 for gas in the liquid state, within which a branch can be arranged to cross the first heat exchanger 61 and thus recondense the gas circulating in the return line 60.

The second heat exchanger 62 is arranged upstream of the first heat exchanger 61 and operates a heat exchange between the gas circulating in the return line and the gas from the supply circuit 3 at the outlet of the tank 2. With the gas leaving the tank 2 being necessarily at a lower temperature, this makes it possible to cool the gas circulating in the return line 60. Said gas is thus pre-cooled initially by crossing the second heat exchanger 62, then is recondensed by crossing the first heat exchanger 61. At the outlet of the latter, the recondensed gas reaches the circuit 8 for gas in the liquid state and then the tank 2 via the outlet orifice 21 or by being projected via the spraying member 20.

FIGS. 6, 7 and 8 represent the second embodiment of the supply and cooling system 1 according to three different operating modes. For each of these operating modes, the two devices meet the supply needs of the gas-consuming devices and/or the supply needs of the cooling circuit 4. The solid lines represent pipes where a fluid circulates therein while the dotted lines represent pipes where no fluid circulates.

FIG. 6 therefore shows a first operating mode of the supply and cooling system 1. In this first operating mode, the first compression device 11 is connected to the supply circuit 3 in order to supply the gas-consuming devices and the second compression device 12 is connected to the cooling circuit 4 in order to supply the latter. The compression stages of the first compression device 11 are therefore arranged in series as shown in FIG. 3, while the compression stages of the second compression device 12 are arranged in parallel as shown in FIG. 4. The fifth valve 45 and the sixth valve 46 are closed in order to isolate the supply circuit 3 and the first compression device 11 from the cooling circuit 4 and from the second compression device 12.

FIG. 7 shows a second operating mode of the supply and cooling system 1. In this second operating mode, the first compression device 11 and the second compression device 12 are connected to the supply circuit 3 in order to supply the gas-consuming devices. The compression stages of the first compression device 11 and of the second compression device 12 are therefore both arranged in series as shown in FIG. 3. The fifth valve 45 and the sixth valve 46 are open in order to connect the second compression device 12 to the supply circuit 3, and the third valve 43 and the fourth valve 44 are closed in order to isolate the cooling circuit 4 from the rest of the supply and cooling system 1.

Although the gas in the liquid state circulating in the circuit 8 for gas in the liquid state is not cooled due to the inactivity of the cooling circuit 4, the gas in the liquid state can, however, circulate therein in order to condense the gas possibly circulating in the return line 60.

FIG. 8 shows a third operating mode of the supply and cooling system 1. In this second operating mode, the first compression device 11 and the second compression device 12 are connected to the cooling circuit 4 in order to supply the latter. The compression stages of the first compression device 11 and of the second compression device 12 are therefore both arranged in parallel as shown in FIG. 4. The fifth valve 45 and the sixth valve 46 are open in order to connect the first compression device 11 to the cooling circuit 4, and the first valve 41 and the second valve 42 are closed in order to isolate the supply circuit 3 from the rest of the supply and cooling system 1.

Because the supply circuit 3 is inactive, the gas evaporating in the tank 2 is not sucked in and there is therefore no excess gas circulating in the return line 60 either. A means for managing the internal pressure of the tank 2 is therefore the use of the circuit 8 for gas in the liquid state in order to cool the gas in the liquid state thanks to the cooling circuit 4, then to return the gas in the cooled liquid state to the tank 2 via the spraying member 20 or the outlet orifice 21.

FIG. 9 shows a third embodiment of the supply and cooling system 1. This third embodiment does not comprise either the circuit for gas in the liquid state described previously or the return line of the second embodiment.

The difference of this third embodiment lies in the positioning of the heat exchanger 17 which here is directly placed at least partially within the tank 2. The heat exchanger 17 therefore participates directly in the management of the pressure of the tank, and not indirectly by cooling the circuit for gas in the liquid state as for the previous embodiments.

The heat exchanger 17 therefore comprises only a single pass through which the refrigerant passes. The pass may consist of a spiral pipe so that the refrigerant path within the heat exchanger 17 is longer. The heat exchanger 17 therefore cools the headspace 200 of the tank 2. The gas having evaporated in the headspace 200 of the tank 2 is therefore condensed in the vicinity of the heat exchanger 17, and falls back into the tank 2. The heat exchanger 17 therefore acts here as a gravity condenser.

The operation of the two compression devices, of the supply circuit 3 and of the cooling circuit 4 is for their part identical to what has been described in FIG. 5.

Of course, the invention is not limited to the examples which have just been described and many modifications can be made to these examples without departing from the scope of the invention.

The invention as has just been described clearly achieves its set objective and makes it possible to propose a supply and cooling system for a floating structure comprising at least one compression device capable of meeting various needs depending on the connection of its compression stages. Variants not described here could be implemented without departing from the context of the invention, provided that, in accordance with the invention, they comprise a supply and cooling system in accordance with the invention.

The invention claimed is:

1. A gas supply and cooling system for a floating structure comprising at least one tank configured to contain the gas, the supply and cooling system comprising:

at least one supply circuit configured to be traversed by gas coming from the at least one tank, and comprising at least one compression device, the at least one supply circuit being configured to connect the at least one compression device to a headspace of the at least one tank, and to supply gas to at least one gas-consuming device which equips the floating structure, at least one cooling circuit configured to be traversed by a refrigerant, comprising at least one heat exchanger configured to participate in an internal pressure management of the at least one tank, an internal heat exchanger and a turbocompressor comprising a compression member arranged upstream of a first pass of the internal heat exchanger and a turbine arranged downstream of the first pass of the internal heat exchanger, the compression member and the turbine being connected in rotation by a shaft, and the cooling circuit being connected to the at least one supply circuit on either side of the at least one compression device, wherein the at least one compression device comprises at least two compression stages, the supply and cooling system comprising a control device configured to connect the compression stages in series when the at least one compression device supplies the gas-consuming device and to connect the compression stages in parallel when the at least one compression device supplies the cooling circuit.

2. The supply and cooling system as claimed in claim 1, comprising a control module comprising a main line passing through each of the compression stages of the at least one compression device.

3. The supply and cooling system as claimed in claim 2, wherein the control module comprises at least one peripheral line connected to the main line and at least one valve which controls the flow circulating on said peripheral line, the peripheral line bypassing a compression stage.

4. The supply and cooling system as claimed in claim 1, wherein the first pass and a second pass are configured for thermal exchange with each other, the first pass being arranged upstream of the at least one heat exchanger and the second pass being arranged downstream of the heat exchanger.

5. The supply and cooling system as claimed in claim 1, wherein the at least one compression device of the at least one supply circuit is a first compression device, the supply and cooling system comprising a second compression device installed in parallel with the first compression device.

6. The supply and cooling system as claimed in claim 5, wherein the second compression device comprises at least two compression stages, the control device being configured to connect the compression stages of the second compression device in series when the second compression device supplies the gas-consuming device and to connect the compression stages of the second compression device in parallel when the second compression device supplies the cooling circuit.

7. The supply and cooling system as claimed in claim 1, comprising a circuit for gas in a liquid state configured to be traversed by gas in the liquid state coming from the at least one tank, and configured to take the gas in the liquid state contained in the at least one tank, the at least one heat exchanger effecting a heat exchange between the gas in the liquid state of the circuit for gas in the liquid state and a refrigerant circulating in the cooling circuit.

8. The supply and cooling system as claimed in claim 7, wherein the circuit for gas in the liquid state comprises a member for spraying the gas in the liquid state into the tank headspace and an outlet orifice arranged in a lower part of the at least one tank.

9. The supply and cooling system as claimed in claim 7, comprising a return line connected to the at least one supply circuit downstream of the at least one compression device and extending as far as the circuit for gas in the liquid state, the supply and cooling system comprising a first heat exchanger effecting a heat exchange between the gas circulating in the return line and the gas circulating in the circuit for gas in the liquid state.

10. The supply and cooling system as claimed in claim 9, comprising a second heat exchanger effecting a heat exchange between the gas circulating in the at least one supply circuit upstream of the compression device, and the gas circulating in the return line upstream of the first heat exchanger.

11. The supply and cooling system as claimed in claim 1, wherein the at least one heat exchanger is arranged at least partially at the headspace of the at least one tank.

12. A method for managing a gas contained in the at least one tank, implemented by the supply and cooling system as claimed in claim 1 comprising:

determining a need to supply the gas-consuming device or a need to manage the pressure inside the at least one tank, and connecting in series or in parallel the compression stages of the compression device by a control module according to the determined need.

13. The management method as claimed in claim 12, wherein the at least one compression device of the at least one supply circuit is a first compression device having compression stages, the supply and cooling system comprises a second compression device having compression stages, and according to a first operating mode, the first compression device, whose compression stages are connected in series, supplies the gas-consuming device while the second compression device, whose compression stages are connected in parallel, supplies the cooling circuit.

14. The management method as claimed in claim 13, during which, according to a second operating mode, the first compression device and the second compression device, whose compression stages are connected in series, supply the gas-consuming device.

15. The management method as claimed in claim 14, during which, according to a third operating mode, the first compression device and the second compression device, whose compression stages are connected in parallel, supply the cooling circuit.

* * * * *